US007784298B2

(12) United States Patent
Ha et al.

(10) Patent No.: US 7,784,298 B2
(45) Date of Patent: Aug. 31, 2010

(54) REFRIGERATOR AND COOLING CONTROL METHOD THEREOF

(75) Inventors: Joo Young Ha, Seoul (KR); Yong Han Kim, Cheonan-si (KR); Jeong Han Kim, Suwon-si (KR); Young Shik Shin, Seongnam-si (KR); Won Jae Yoon, Seoul (KR); Jae Seung Lee, Hwaseong-Gun (KR); Hye Ran Lee, Goonpo-Si (KR); Jung Soo Lim, Seoul (KR); Chang Hak Lim, Hwasung-si (KR); Kyung Hee Hahm, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 798 days.

(21) Appl. No.: 11/482,046

(22) Filed: Jul. 7, 2006

(65) Prior Publication Data

US 2007/0163287 A1 Jul. 19, 2007

(30) Foreign Application Priority Data

Jan. 14, 2006 (KR) ..... 10-2006-0004199

(51) Int. Cl.
*F25C 1/22* (2006.01)

(52) U.S. Cl. ..... 62/340; 62/137

(58) Field of Classification Search ..... 62/340, 62/389, 441, 137
See application file for complete search history.

(56) References Cited

U.S. PATENT DOCUMENTS 4,545,505 A * 10/1985 Mueller et al. ..... 222/65
2006/0249029 A1 * 11/2006 Hahm et al. ..... 99/275

FOREIGN PATENT DOCUMENTS

JP 10-185382 7/1998

OTHER PUBLICATIONS

Office Action issued Jun. 6, 2008 in corresponding Chinese Patent Application No. 200610108091.6.

* cited by examiner

*Primary Examiner*—Melvin Jones
(74) *Attorney, Agent, or Firm*—Staas & Halsey LLP

(57) ABSTRACT

A refrigerator which can control a supercooling degree corresponding to user's taste or kinds of food, and a cooling control method thereof are disclosed. The refrigerator has a function of supercooling a drink, and includes an input unit to select a slush level for adjusting a supercooling degree of the drink in response to a user's command, a memory unit to store information about a supercooling temperature of the drink corresponding to a selected slush level, and a controller to adjust the supercooling degree of the drink by controlling a temperature within the supercooling compartment based on the information about the supercooling temperature of the drink stored in the memory unit.

15 Claims, 8 Drawing Sheets

FIG. 3

| Slush level | Supercooling temperature |
|---|---|
| Soft slush | -6.2°C |
| General slush | -8.0°C |
| Hard slush | -9.8°C |

FIG. 6

| Slush level / Kind of drink | Soft slush | General slush | Hard slush |
|---|---|---|---|
| Water | -6.2°C | -8.0°C | -9.8°C |
| Canned coffee | -8.1°C | -9.0°C | -9.9°C |
| Canned sikhae | -9.2°C | -9.7°C | -10.2°C |
| Juice | -8.7°C | -9.8°C | -10.9°C |
| Bottle coffee | -9.1°C | -10.2°C | -11.3°C |

REFRIGERATOR AND COOLING CONTROL METHOD THEREOF

CROSS-REFERENCE TO RELATED APPLICATIONS

This application claims the benefit of Korean Patent Application No. 2006-0004199, filed on Jan. 14, 2006 in the Korean Intellectual Property Office, the disclosure of which is incorporated herein by reference.

BACKGROUND OF THE INVENTION

1. Field of the Invention

The present invention relates to a refrigerator that can store drinks in a supercooled state, and, more particularly, to a refrigerator, which can control a supercooling degree corresponding to user's taste or kinds of food, and a cooling control method thereof.

2. Description of the Related Art

Generally, a refrigerator or refrigeration apparatus serves to preserve various foods in a fresh state for a long period of time using chilled air, which is generated and supplied to storage spaces as a refrigerant absorbs heat from the surroundings via a phase change from liquid to vapor in a typical refrigeration cycle within the refrigerator. Recently, the refrigerator requires various additional functions as well as simple freezing, refrigerating, and preserving functions due to changes in lifestyle and taste of users. For example, the refrigerator has not only a function to preserve meats, fish, vegetables, kimchi, etc. in different states, but also a function to provide drinks (such as water, coffee, sikhae, juice, alcohol, etc.) in a supercooled state, which can be used for making, for example, a slush drink.

Drinks generally change in phase from liquid to solid below a freezing point under a pressure of 1 atm, but in some cases, it is into a supercooled state rather than the solid phase. Such a state where a liquid is in a supercooled state rather than in the solid phase below the freezing point is thermodynamically called a meta-stable state. When the drink is in the meta-stable state, the drink is in neither an equilibrium state nor a completely unstable state. Thus, if there is external disturbance, the drink instantaneously changes in phase from the supercooled state to the solid phase. In other words, when the supercooled drink is supplied to a cold cup, or subjected to impact or vibration, it changes to a phase not in a completely frozen or melted state, and such a drink is referred to as "slush."

As such, a slush drink is generally made by supercooling a drink such as coffee, juice (strawberry, tomato, orange, apple, etc.), alcohol, etc. In this regard, Japanese Patent Laid-open Publication No. 2003-214753 discloses a refrigerator which can make such a drink in a supercooled state.

The refrigerator disclosed in the publication enhances an interior configuration of a body, and includes a chilled air supplying duct and chilled air suctioning duct respectively positioned on opposite sides of a storage compartment acting to preserve drinks therein, and a connection duct positioned on an upper side of the storage compartment to connect the chilled air supplying duct to the chilled air suctioning duct such that the chilled air supplying duct, the chilled air suctioning duct, and the connection duct constitute a path along which chilled air continuously circulates so as to maintain uniform temperature distribution within the storage compartment.

Meanwhile, although it is important for the refrigerator to preserve the drink in the supercooled state by maintaining the uniform temperature distribution within the storage compartment, it is more important for the refrigerator to supply a good quality slush drink to users by maintaining the supercooled state of the drink therein. For this purpose, it is necessary to maintain a temperature distribution according to time as uniform as possible within the storage compartment where the drink is preserved. In other words, even though the storage compartment has a uniform temperature when averaged over a period of time, if the temperature of the storage compartment varies over a wide range according to time, the supercooled drink may be frozen when the storage compartment is at the lowest temperature in this range, failing to produce the slush drink.

In addition, assuming that a temperature required for making the drink a supercooled state is −5° C., since a conventional supercooling refrigerator works using a constant operation pattern irrespective of user's taste in order to maintain the temperature of the storage compartment at −5° C., the user cannot select a supercooling degree of the drink even if he or she wants to adjust a ratio of supercooled grains (hereinafter referred to as a "slush level") of the drink according to taste. As a result, with the conventional refrigerator, it is impossible to produce slush drinks (such as soft slush, general slush, hard slush, and the like) based on the user's taste, therefore failing to satisfy demands of the user.

Furthermore, the conventional refrigerator does not allow selective adjustment of the supercooling degree for maintaining an optimal supercooling temperature according to kinds of drink. Thus, it is impossible for the refrigerator to maintain an optimally supercooled state of the drink according to the kinds of drink (for example, coffee, juice, alcohol, and the like) or to the properties of containers (for example, a can or a glass bottle) which contain the drink.

SUMMARY OF THE INVENTION

Accordingly, it is an aspect of the present invention to provide a refrigerator, which has a function to adjust a supercooling degree of a drink in order to permit selective adjustment of a slush level on the basis of user's taste when supercooling the drink, and a cooling adjustment method thereof.

It is another aspect of the present invention to provide a refrigerator, which allows a supercooling temperature of the drink to be set differently according to the slush level based on the user's taste or kinds of drink in order to permit selective adjustment of the supercooling degree of the drink, and the cooling adjustment method thereof.

Additional aspects and/or advantages of the invention will be set forth in part in the description which follows and, in part, will be apparent from the description, or may be learned by practice of the invention.

In accordance with one aspect of the present invention, a refrigerator having a function of supercooling a drink is provided, including: an input unit to select a slush level for adjusting a supercooling degree of the drink in response to a user's command; and a controller to perform adjustment of the supercooling degree of the drink based on a selected slush level.

The refrigerator may further include: a memory unit to store information about a supercooling temperature of the drink related to the slush level, wherein the controller adjusts the supercooling degree of the drink based on the information about the supercooling temperature of the drink stored in the memory unit.

The controller may adjust the supercooling degree of the drink corresponding to a general slush level when the slush level is not selected.

In accordance with another aspect of the present invention, a refrigerator including a supercooling compartment to supercool and preserve a drink is provided, further including: an input unit to select a slush level for adjusting a supercooling degree of the drink in response to a user's command; a memory unit to store information about a supercooling temperature of the drink corresponding to a selected slush level; and a controller to adjust the supercooling degree of the drink by controlling a temperature within the supercooling compartment based on the information about the supercooling temperature of the drink stored in the memory unit.

The input unit may include a button to select a kind of drink, and the controller may adjust a supercooling degree of the drink according to the kind of drink selected using the button.

The controller may adjust the supercooling degree of the drink to a slush level of a reference drink when the kind of drink is not selected.

The controller may adjust the supercooling degree of the drink to a general slush level of a reference drink when the slush level is not selected.

In accordance with yet another aspect of the present invention, a cooling control method for a refrigerator including a supercooling compartment to supercool and preserve a drink is provided, the method including: selecting a slush level for adjusting a supercooling degree of the drink; reading information about a supercooling temperature of the drink corresponding to a selected slush level; and adjusting the supercooling degree of the drink by controlling a temperature of the supercooling compartment based on the information about the read supercooling temperature of the drink.

The supercooling degree of the drink may be adjusted by reading information about a supercooling temperature of the drink corresponding to a general slush level of the drink when the slush level is not selected.

The method may further include: selecting a kind of drink, and the supercooling degree of the drink may be adjusted by reading information about a supercooling temperature of the drink according to the kind of drink.

The supercooling degree of the drink may be adjusted by reading information about a supercooling temperature related to the slush level of a reference drink when the kind of drink is not selected.

The supercooling degree of the drink may be adjusted by reading information about a supercooling temperature related to a general slush level of a reference drink when the slush level is not selected.

BRIEF DESCRIPTION OF THE DRAWINGS

These and/or other aspects and advantages of the invention will become apparent and more readily appreciated from the following description of the embodiments, taken in conjunction with the accompanying drawings, of which:

FIG. 3 is a table illustrating information about a supercooling temperature of a drink related to a slush level in the refrigerator in accordance with the first embodiment;

FIG. 6 is a table illustrating information about a supercooling temperature of a drink related to a slush level and a kind of drink in the refrigerator in accordance with the second embodiment;

DETAILED DESCRIPTION OF THE PREFERRED EMBODIMENTS

Reference will now be made in detail to the embodiments of the present invention, examples of which are illustrated in the accompanying drawings. The embodiments are described below to explain the invention by referring to the figures.

Figure 1:
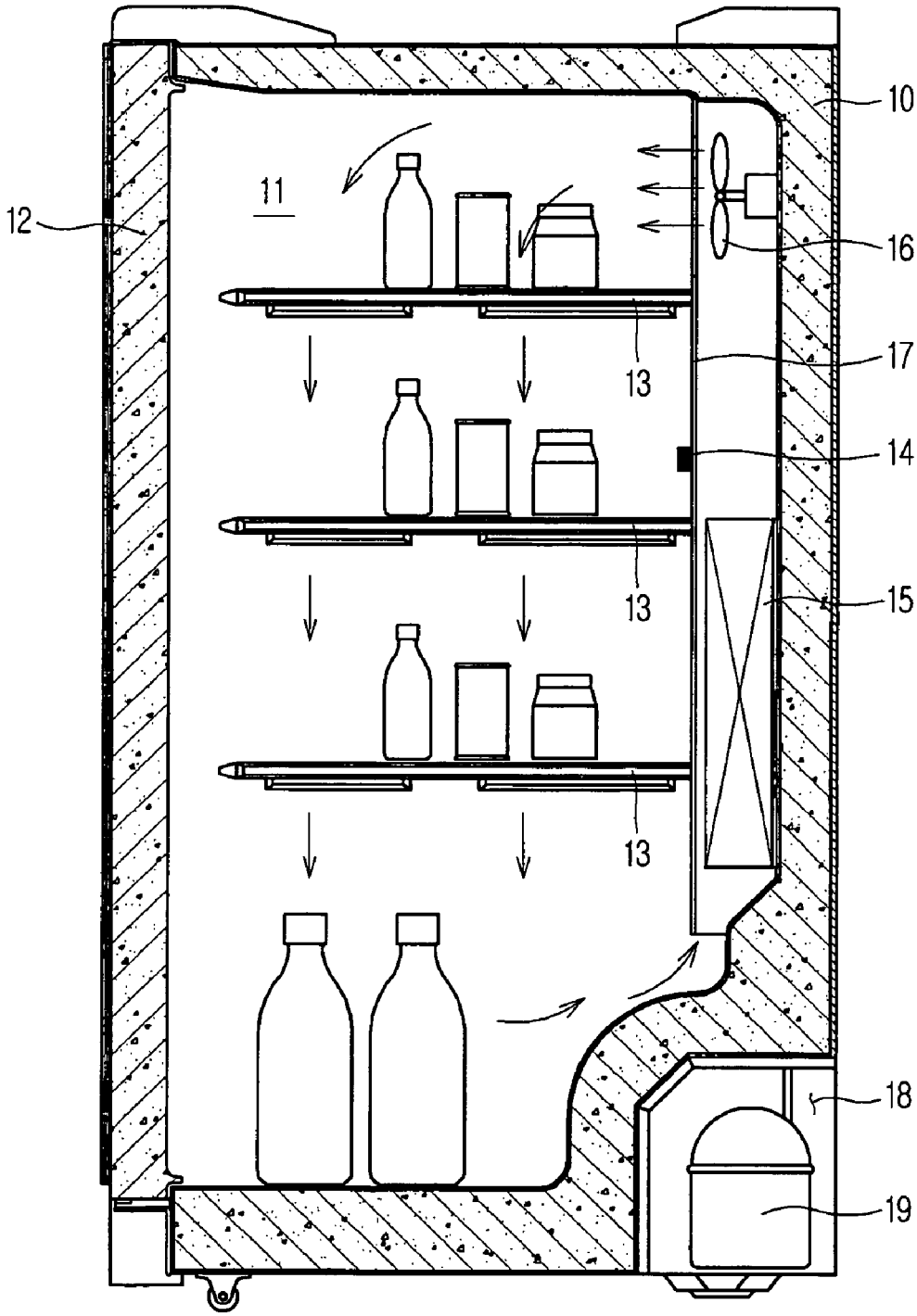
FIG. 1 is a side elevation illustrating a refrigerator in accordance with the present invention.

FIG. 1 is a side elevation illustrating a refrigerator of the present invention.

Referring to FIG. 1, the refrigerator of the invention includes a body 10 which has a supercooling compartment 11 to supercool and preserve food and drinks in different manners, and a door 12 to open or close a front side of the supercooling compartment 11. The supercooling compartment 11 is divided into upper and lower spaces by a plurality of shelves 13 such that several kinds of drink (such as drink bottles or cans) can be placed on the shelves 13 in the respective spaces. The supercooling compartment 11 is provided at one position of a wall with a temperature sensor 14 to detect the temperature of the supercooling compartment 11 so that the supercooling compartment 11 is maintained at a highly constant supercooling temperature (for example, −8° C.), enabling the drinks to be preserved in a supercooled state.

The refrigerator further includes an evaporator 15 to refrigerate the supercooling compartment 11 at a rear side within the supercooling compartment 11, a fan 16 at one side of the evaporator 15 to circulate chilled air into the supercooling compartment 11, and chilled air guide duct 17 to guide circulation of the chilled air within the supercooling compartment 11.

The body 10 of the refrigerator is provided at a lower rear side with a machine compartment 18 in a separate space, in which a compressor 19 and the like are installed.

Figure 2:
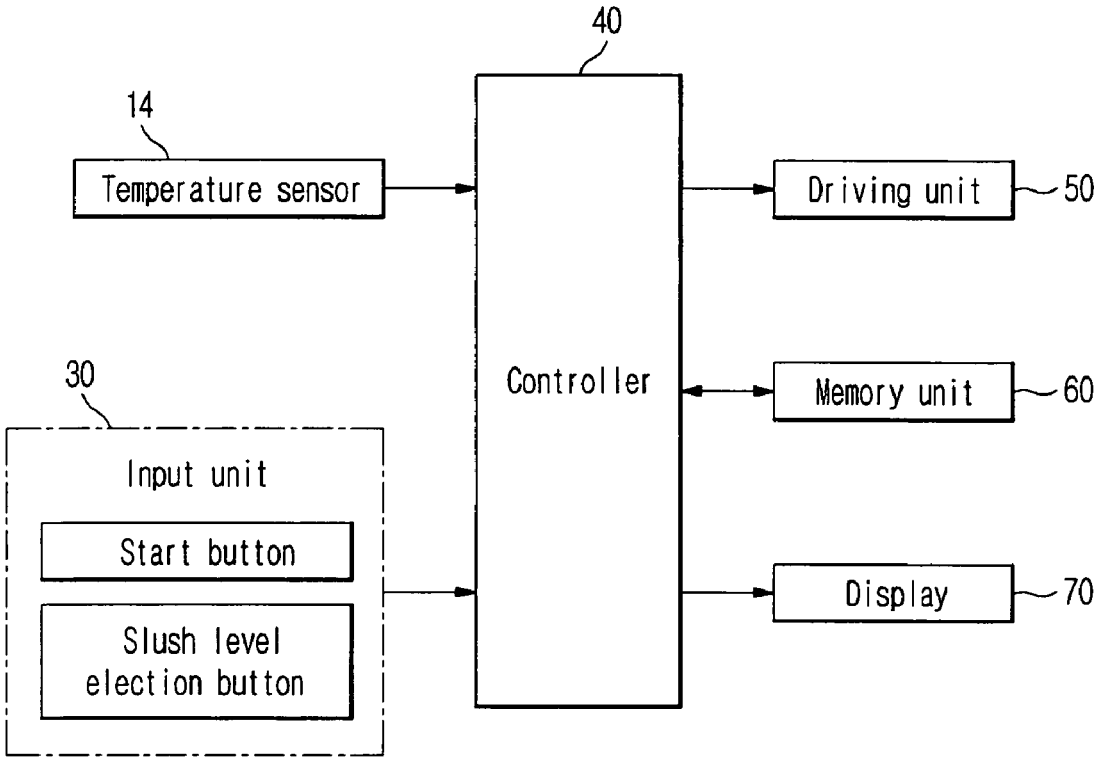
FIG. 2 is a block diagram illustrating a refrigerator in accordance with a first embodiment of the present invention.

FIG. 2 is a block diagram illustrating a refrigerator in accordance with a first embodiment of the present invention. The refrigerator further includes an input unit 30 to input a control command, a controller 40, a driving unit 50, a memory unit 60, and a display 70 to display an operating state of the refrigerator in addition to components shown in FIG. 1.

The input unit 30 is provided with a start button to start controlling the temperature of the supercooling compartment 11 in which the drinks are preserved in a supercooled state, and plural buttons including a slush level selection button to select a slush level (for example, soft slush, general slush, hard slush).

The controller 40 includes a microcomputer which can control overall operation of the refrigerator. The controller 40 provides a mode to allow a user to selectively control the slush level when supercooling the drink. Thus, the controller 40 determines whether or not a signal to change a supercooling temperature of the drink is input by a user, and if it is determined that the signal is input, the controller 40 adjusts a supercooling degree of the drink by controlling the supercooling compartment 11 to have a temperature corresponding to the supercooling temperature of the drink to be changed according to the signal based on user's taste.

The memory unit 60 stores information about an optimal supercooling temperature related to a slush level of the drink, which can be used to control the supercooling compartment 11 to have different temperatures set corresponding to the slush levels based on the user's taste when controlling the temperature of the supercooling compartment 11 in which the drinks are stored in the supercooled state.

Operation and effect of the refrigerator, and a cooling control method thereof will be described with reference to FIGS. 2 to 4.

Figure 4:
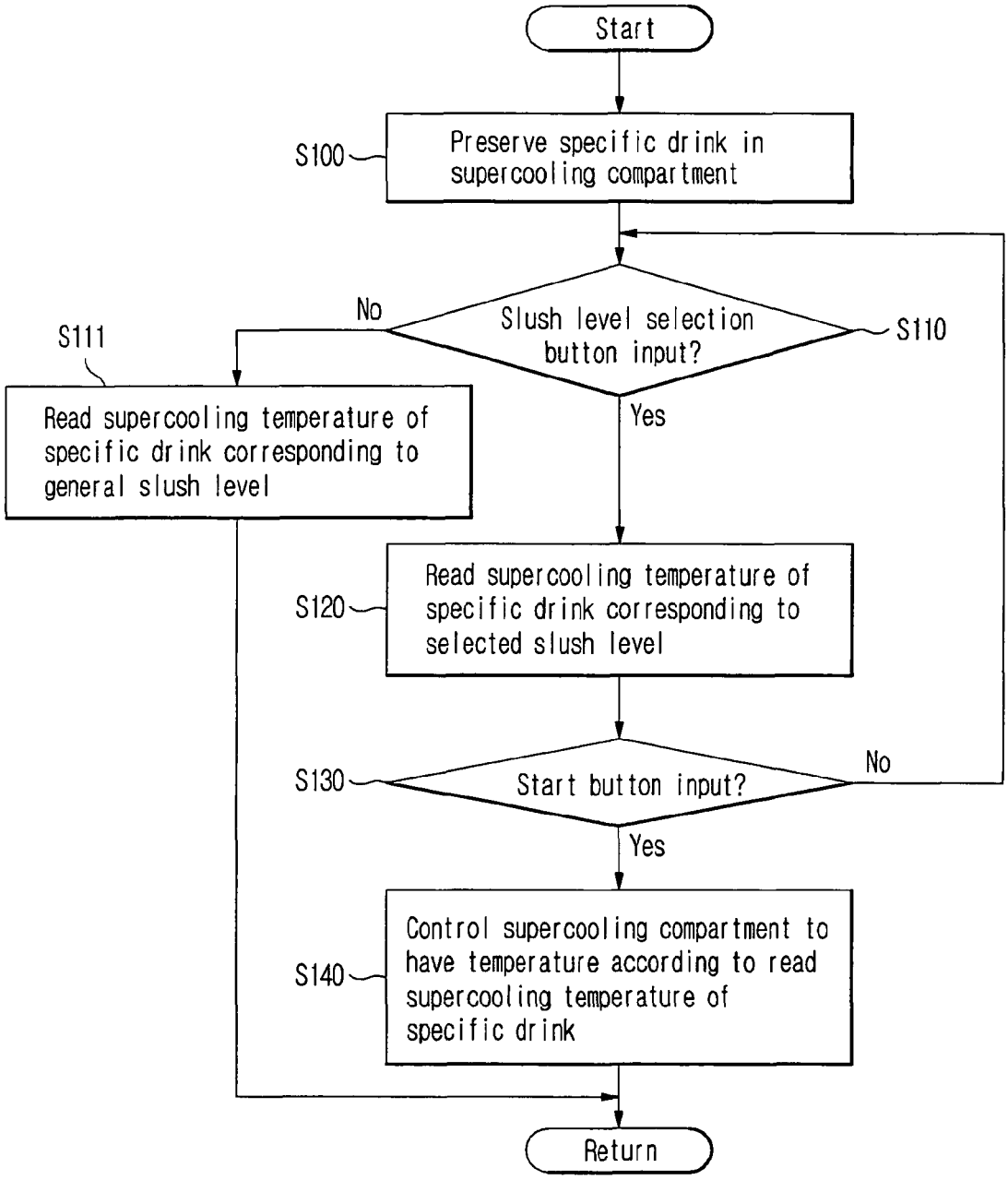
FIG. 4 is a flow diagram illustrating a method for adjusting a supercooling degree of a specific drink according to a slush level in the refrigerator in accordance with the first embodiment.

FIG. 4 is a flow diagram illustrating a method for adjusting a supercooling degree of a specific drink according to a slush level in the refrigerator in accordance with the first embodiment.

First, after a specific drink (for example, water) is input to the supercooling compartment 11 (S100), a slush level corresponding to a supercooling degree of a specific drink is selected using a slush level selection button on the input unit 11.

Then, the controller 40 determines whether or not a slush level selection signal is input from the input unit 30 (S110). If it is determined that the slush level selection signal is not input, the controller 40 reads a supercooling temperature of the drink corresponding to a general slush level of the specific drink stored in the memory unit 60 as shown in FIG. 3 (S111).

If it is determined that the slush level selection signal is input, the controller 40 reads a supercooling temperature of the drink according to a selected slush level stored in the memory unit 60 as shown in FIG. 3 (S120).

After reading the supercooling temperature of the specific drink corresponding to the slush level, the controller 40 determines whether or not a supercooling start signal is input from a start button on the input unit 30 (S130). If it is determined that the supercooling start signal is input, the controller 40 controls the supercooling compartment 11 to be maintained at an interior temperature (a temperature about 2~3° C. or 4~5° C. less than the supercooling temperature) suitable for the slush level of the specific drink by driving the compressor 19, the fan 16 and the like according to the read supercooling temperature of the specific drink, thereby adjusting a supercooling degree of the specific drink corresponding to the user's taste (S140).

In the above, the method of adjusting the supercooling degree of the specific drink according to the slush level suitable for the user's taste has been described. In the following, a method of adjusting the supercooling degree according to a kind of drink will be described.

Figure 5:
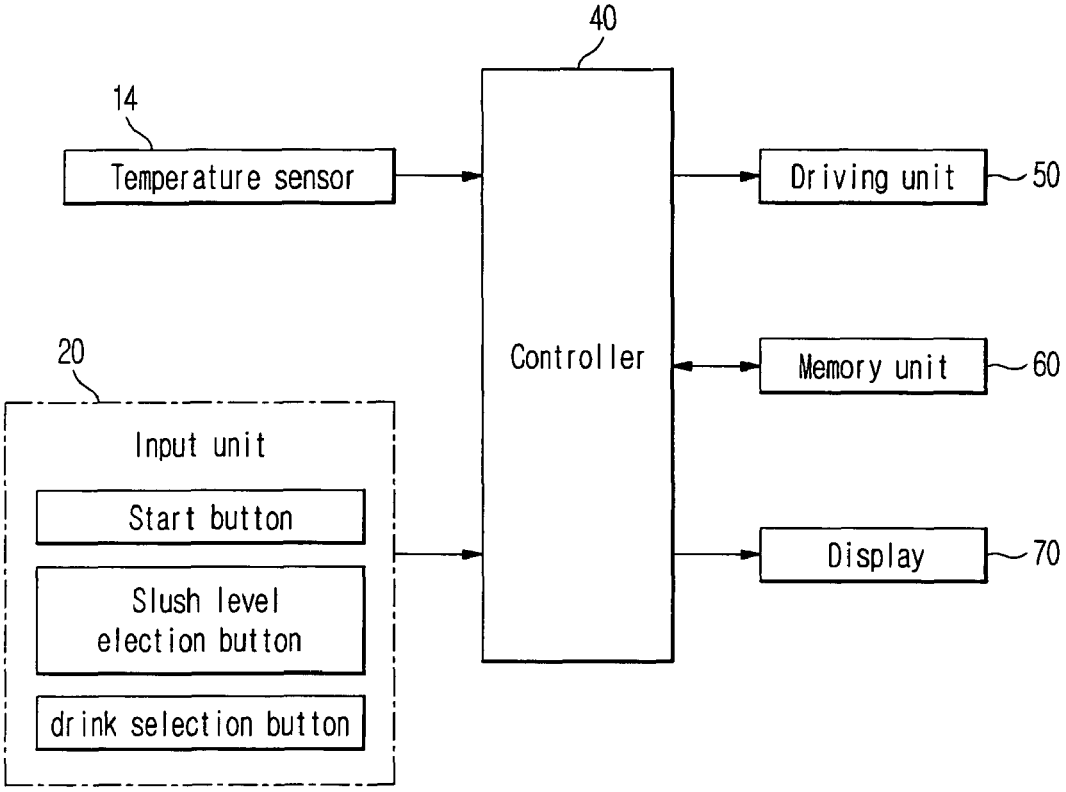
FIG. 5 is a block diagram illustrating a refrigerator in accordance with a second embodiment of the present invention.

FIG. 5 is a block diagram illustrating a refrigerator in accordance with a second embodiment of the present invention. Referring to FIG. 5, the refrigerator also includes an input unit 20, a controller 40, a driving unit 50, a memory unit 60, and a display 70. Like components are denoted by like reference numerals of the first embodiment, and will not be described hereinafter.

The input unit 20 is provided with a start button to start controlling the temperature of the supercooling compartment 11 in which the drinks are preserved in a supercooled state, and plural buttons, such as a slush level selection button to select a slush level (for example, soft slush, general slush, hard slush) of the drinks, a drink selection button to select a kind of drink such as water, coffee, sikhae, juice, alcohol, and the like.

The controller 40 provides modes to allow a user to selectively adjust a slush level according to a supercooling degree of the drink or to the kind of drink when supercooling the drinks. Thus, the controller 40 determines whether or not a signal to change a supercooling temperature of the drink is input by a user, and if it is determined that the signal to change the supercooling temperature of the drink is input, the controller 40 adjusts a supercooling degree of the drink by controlling the supercooling compartment 11 to have a temperature corresponding to the supercooling temperature of the drink to be changed suitable for user's taste or the kind of drink.

The memory unit 60 stores information about an optimal supercooling temperature related to the slush level of the drink or the kind of the drink, which can be used to control the supercooling compartment 11 to have different temperatures set according to the slush level corresponding to user's taste or the kind of drink when controlling the temperature of the supercooling compartment 11 in which the drinks are stored in the supercooled state.

Figure 7:
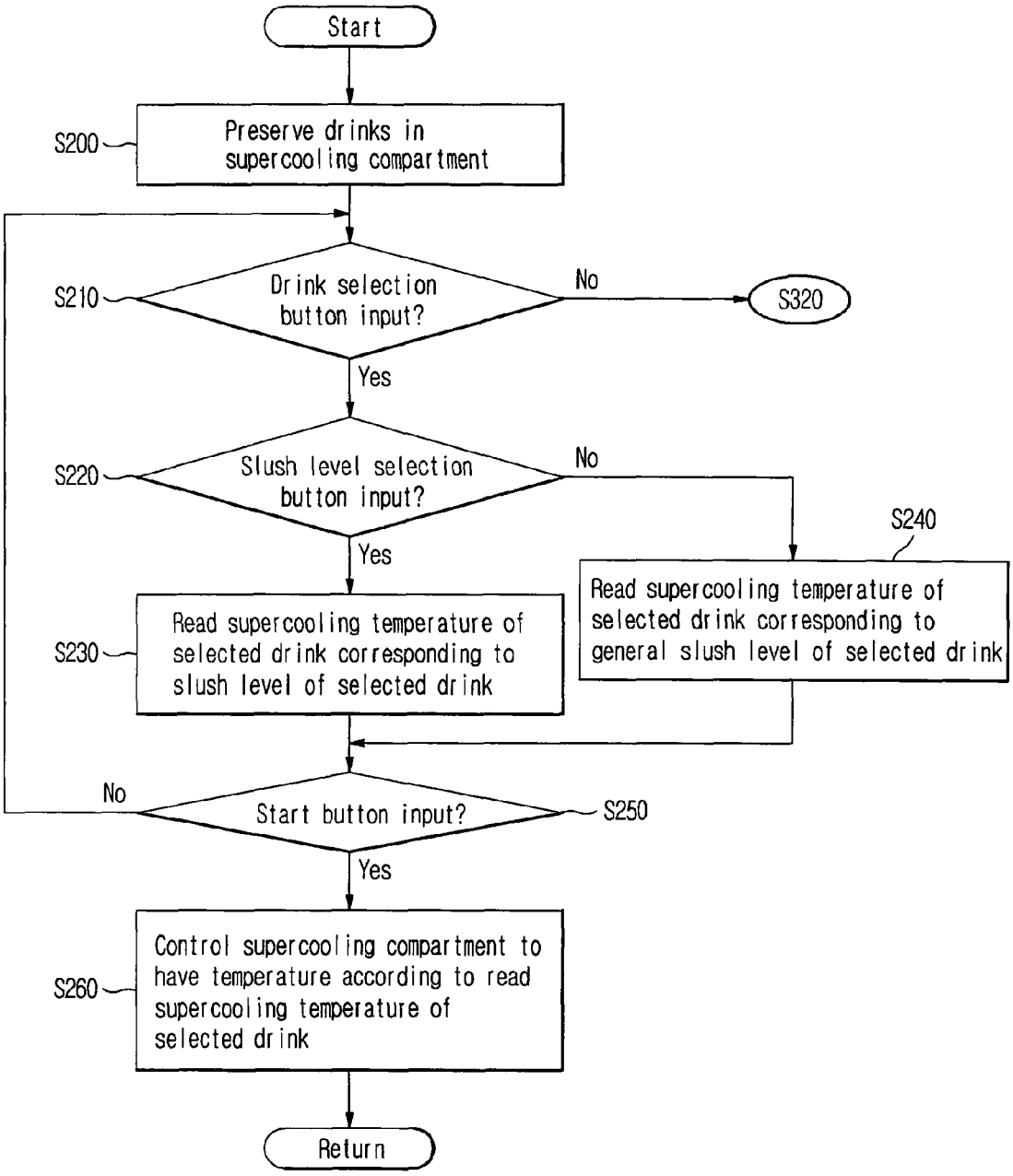
FIG. 7 is a flow diagram illustrating a method for adjusting a supercooling temperature of a drink according to a slush level or a kind of drink in the refrigerator in accordance with the second embodiment.

FIG. 7 is a flow diagram illustrating a method for adjusting a supercooling temperature of a drink corresponding to a slush level or a kind of drink in the refrigerator in accordance with the second embodiment.

First, after specific drinks (water, canned coffee, canned sikhae, juice, bottled coffee, etc.) are input to the supercooling compartment 11 (S200), a kind of drink is selected using a drink selection button on the input unit 20.

Then, the controller 40 determines whether or not a drink selection signal is input from the input unit 20 (S210). If it is determined that the drink selection signal is not input at S210, the process moves to S320 which will be described later.

If it is determined that the drink selection signal is input, a slush level according to a supercooling degree of a selected drink is selected by operating a slush level selection button on the input unit 20.

Then, the controller 40 determines whether or not the slush level selection signal is input from the input unit 20 (S220). If it is determined that the slush level selection signal is input, the controller 40 reads a supercooling temperature of the selected drink according to a selected slush level stored in the memory unit 60 as shown in FIG. 6 (S230).

If it is determined that the slush level selection signal is not input, the controller 40 reads a supercooling temperature of the selected drink according to a general slush level of the selected drink stored in the memory unit 60 as shown in FIG. 6 (S240).

After reading the supercooling temperature of the selected drink corresponding to the selected slush level or to the general slush level, the controller 40 determines whether or not a supercooling start signal is input from a start button on the input unit 20 (S250). If it is determined that the supercooling start signal is input, the controller 40 controls the supercooling compartment 11 to be maintained at an interior temperature suitable for the selected slush level or for the general slush level by driving the compressor 19, the fan 16 and the like according to the read supercooling temperature of the specific drink, thereby adjusting a supercooling degree of the specific drink corresponding to the user's taste or to the kind of the drink (S260).

In the above, the method of adjusting the supercooling degree of the selected drink according to the slush level suitable for the user's taste or the kind of drink has been described. In the following description, a method of adjusting the supercooling degree of the drink when the kind of drink is not selected will be described.

Figure 8:
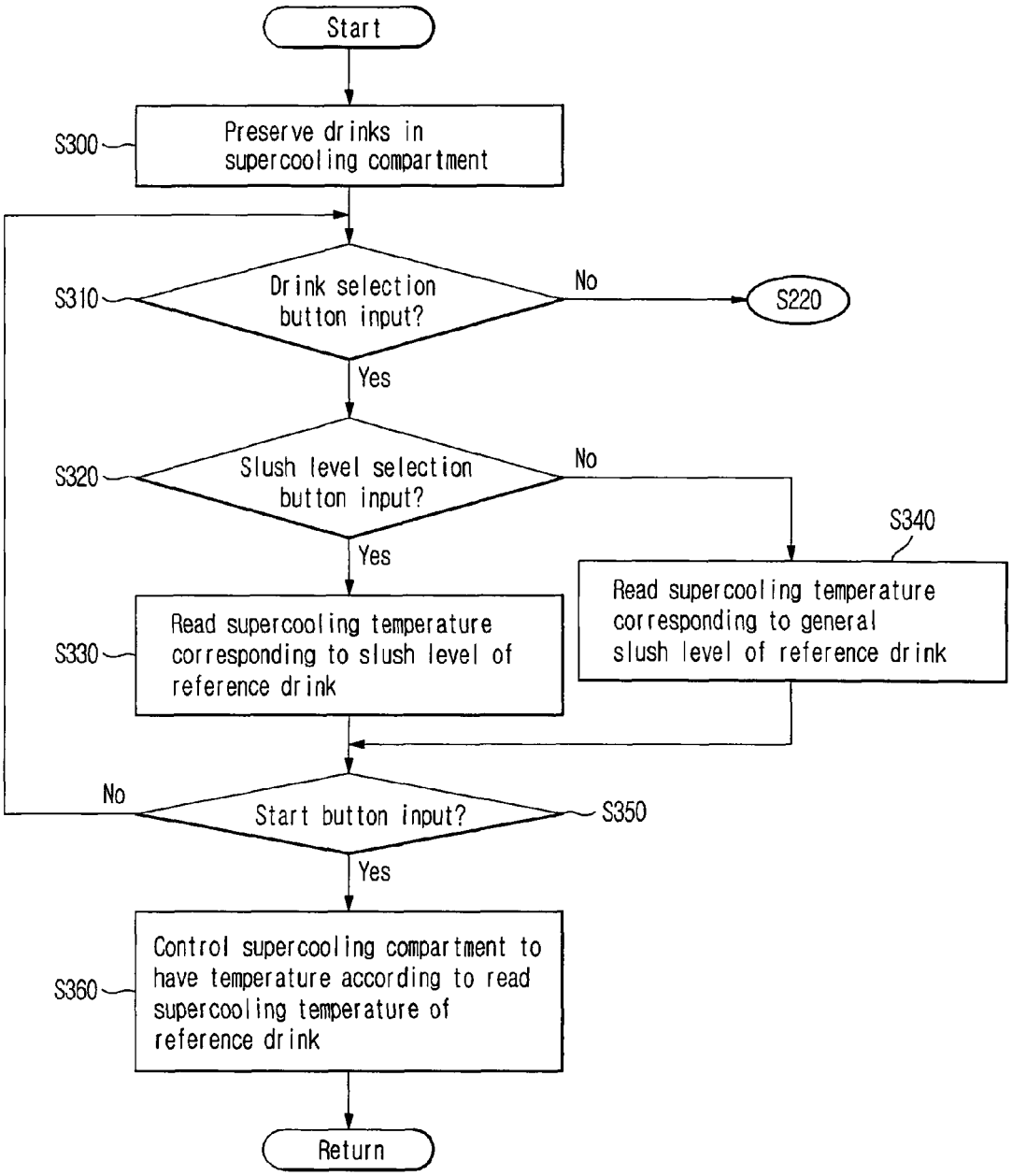
FIG. 8 is a flow diagram illustrating a method for adjusting a supercooling degree of the drink according to the slush level in the refrigerator in accordance with the second embodiment.

FIG. 8 is a flow diagram illustrating a method for adjusting a supercooling degree of a drink according to a slush level in the refrigerator in accordance with the second embodiment.

First, after specific drinks (water, canned coffee, canned sikhae, juice, bottle coffee, etc.) are input to the supercooling compartment 11 (S300), a kind of drink is selected using the drink selection button on the input unit 20.

Then, the controller 40 determines whether or not a drink selection signal is input from the input unit 20 (S310). If it is determined that the drink selection signal is input, the process moves to S220 which is described above, and the process following S220 is performed.

If it is determined that the drink selection signal is not input, a slush level according to a supercooling degree of the drink preserved in the supercooling compartment 11 is selected by operating a slush level selection button on the input unit 20.

Then, the controller 40 determines whether or not the slush level selection signal is input from the input unit 20 (S320). If it is determined that the slush level selection signal is input, the controller 40 reads a supercooling temperature of a reference drink (specifically, water) stored in the memory unit 60 as shown in FIG. 6, according to the slush level of water as a reference drink irrespective of the kind of drink preserved in the supercooling compartment 11 (S330).

If it is determined that the slush level selection signal is not input, the controller 40 reads a supercooling temperature of the reference drink (water) stored in the memory unit 60 as shown in FIG. 6, according to a general slush level of the reference drink (water) (S340).

After reading the supercooling temperature corresponding to the selected slush level of the reference drink (water) or to the general slush level thereof, the controller 40 determines whether or not a supercooling start signal is input from a start button on the input unit 20 (S350). If it is determined that the supercooling start signal is input, the controller 40 controls the supercooling compartment 11 to be maintained at an interior temperature corresponding to the selected slush level of water as the reference drink or to the general slush level by driving the compressor 19, the fan 16 and the like according to the read supercooling degree of the reference drink, thereby adjusting a supercooling degree of water as the reference drink corresponding to the user's taste (S360).

In FIG. 6, the supercooling temperatures related to the slush levels and the kinds of drink were obtained by testing general drinks available in various markets. As shown in FIG. 6, the supercooling temperatures are lower than 0° C.

As can be appreciated from FIG. 6, even though the drinks are the same kind, the drinks may have different supercooling temperatures according to the property of containers in which the drinks are contained. Accordingly, it can be understood that the supercooling temperature of the drink can change depending on an amount or concentration of the drink.

As such, the refrigerator of the present invention enables a supercooling temperature of a drink to be set corresponding to a slush level of the drink such as soft slush, general slush and hard slush based on data for a supercooling degree for respective general drinks, which is obtained by generalizing a supercooling degree distribution for the respective general drinks.

As apparent from the above description, according to the present invention, the refrigerator, and the cooling control method thereof have an advantageous effect in that, since the refrigerator has a function of adjusting a supercooling degree of a drink, it is possible to selectively adjust a slush level of the drink according to user's taste when supercooling the drink.

In addition, according to the present invention, the refrigerator enables the supercooling compartment to have different temperatures set according to slush levels corresponding to the user's taste or according to a kind of drink, thereby allowing selective adjustment of the supercooling degree of the drink.

Although a few embodiments of the present invention have been shown and described, it would be appreciated by those skilled in the art that various modifications, additions and substitutions may be made in these embodiments without departing from the principle and spirit of the invention, the scope of which defined in the claims and their equivalents.

What is claimed is:

1. A refrigerator having a function of supercooling a drink, comprising:

a supercooling compartment to supercool and preserve the drink;

an input unit to select a slush level for adjusting a supercooling degree of the drink in response to a user's command; and a controller to perform adjustment of the supercooling degree of the drink based on a selected slush level.

2. The refrigerator according to claim 1, further comprising:

a memory unit to store information about a supercooling temperature of the drink related to the slush level, wherein the controller adjusts the supercooling degree of the drink based on the information about the supercooling temperature of the drink stored in the memory unit.

3. The refrigerator according to claim 1, wherein the controller adjusts the supercooling degree of the drink corresponding to a general slush level when the slush level is not selected.

4. A refrigerator comprising:

a supercooling compartment to supercool and preserve a drink;

an input unit to select a slush level for adjusting a supercooling degree of the drink in response to a user's command;

a memory unit to store information about a supercooling temperature of the drink corresponding to a selected slush level; and a controller to adjust the supercooling degree of the drink by controlling a temperature within the supercooling compartment based on the information about the supercooling temperature of the drink stored in the memory unit.

5. The refrigerator according to claim 4, wherein the input unit comprises a button to select a kind of drink, and the controller adjusts a supercooling degree of the drink according to the kind of drink selected using the button.

6. The refrigerator according to claim 5, wherein the controller adjusts the supercooling degree of the drink to a slush level of a reference drink when the kind of drink is not selected.

7. The refrigerator according to claim 6, wherein the controller adjusts the supercooling degree of the drink to a general slush level of a reference drink when the slush level is not selected.

8. A cooling control method for a refrigerator comprising a supercooling compartment to supercool and preserve a drink, the method comprising:

selecting a slush level for adjusting a supercooling degree of the drink;

reading information about a supercooling temperature of the drink corresponding to a selected slush level; and adjusting the supercooling degree of the drink by controlling a temperature of the supercooling compartment based on the information about the read supercooling temperature of the drink.

9. The method according to claim 8, wherein the supercooling degree of the drink is adjusted by reading information about a supercooling temperature of the drink corresponding to a general slush level of the drink when the slush level is not selected.

10. The method according to claim 8, further comprising:

selecting a kind of drink, and wherein the supercooling degree of the drink is adjusted by reading information about a supercooling temperature of the drink according to the kind of drink selected.

11. The method according to claim 10, wherein the supercooling degree of the drink is adjusted by reading information about a supercooling temperature related to the slush level of a reference drink when the kind of drink is not selected.

12. The method according to claim 11, wherein the supercooling degree of the drink is adjusted by reading information about a supercooling temperature related to a general slush level of a reference drink when the slush level is not selected.

13. The refrigerator according to claim 1, further comprising a display to display an operating state of the refrigerator.

14. The refrigerator according to claim 1, wherein the selected slush levels comprise soft slush, a general slush and a hard slush.

15. The refrigerator according to claim 1, wherein the controller comprises a memory unit storing an optimal supercooling temperature of the drink.

* * * * *